US009003964B2

(12) United States Patent
Roth et al.

(10) Patent No.: US 9,003,964 B2
(45) Date of Patent: Apr. 14, 2015

(54) APPARATUS AND METHOD FOR FORMING BUNDLES COMPOSED OF PRINTED PRODUCTS

(75) Inventors: André Roth, Zofingen (CH); Roman Wyss, Oberbuchsiten (CH)

(73) Assignee: Mueller Martini Holdings AG, Hergiswil (CH)

( * ) Notice: Subject to any disclaimer, the term of this patent is extended or adjusted under 35 U.S.C. 154(b) by 516 days.

(21) Appl. No.: 13/301,853

(22) Filed: Nov. 22, 2011

(65) Prior Publication Data

US 2012/0132091 A1 May 31, 2012

(30) Foreign Application Priority Data

Nov. 30, 2010 (CH) ..... 2015/10

(51) Int. Cl.

| | |
|---|---|
| ***B65H 31/30*** | (2006.01) |
| ***B65H 31/32*** | (2006.01) |
| ***B65H 31/02*** | (2006.01) |
| ***B65H 63/02*** | (2006.01) |
| ***B65B 63/02*** | (2006.01) |
| *B65B 25/14* | (2006.01) |
| *B65B 27/08* | (2006.01) |

(52) U.S. Cl.

CPC ..... *B65H 31/3018* (2013.01); *B65B 63/02* (2013.01); *B65H 31/02* (2013.01); *B65H 31/3081* (2013.01); *B65H 2301/42112* (2013.01); *B65H 2301/4213* (2013.01); *B65H 2301/4223* (2013.01); *B65H 2402/351* (2013.01); *B65H 2405/323* (2013.01); *B65H 2405/324* (2013.01); *B65B 25/145* (2013.01); *B65B 27/08* (2013.01); *Y10S 414/12* (2013.01)

(58) Field of Classification Search

CPC ..... B65H 31/32; B65H 2301/4223; B65H 31/3009; B65H 31/34; B65H 33/16

USPC ..... 100/3, 7, 35, 45, 215, 218, 295; 414/790, 790.1, 790.2, 790.4, 791, 414/788.1, 788.9, 789.9, 907, 788

See application file for complete search history.

(56) References Cited

U.S. PATENT DOCUMENTS 4,397,229 A * 8/1983 Merwarth et al. ..... 100/7
4,953,344 A * 9/1990 Wallace ..... 53/528

(Continued)

FOREIGN PATENT DOCUMENTS

WO WO-99/10264 A1 3/1999

OTHER PUBLICATIONS

International Search Report issued in CH20152010 dated Apr. 1, 2011.

*Primary Examiner* — Jimmy T Nguyen

(74) *Attorney, Agent, or Firm* — Venable LLP; Robert Kinberg

(57) ABSTRACT

An apparatus for forming bundles of printed products includes a lift element that moves vertically inside a holding area. The printed products are deposited on the lift element when the lift element is in an upper position. The lift moves the deposited printed products downward into the holding area so that the printed products are in position to subsequently be compressed into a bundle by pressing the printed products with an upward movement against a pressing element. The lift transports the compressed bundle to a lower position in the holding area where the lift element moves out of the holding area to a position in which the bundle is released to drop onto a support element. The lift element thereafter is moveable from the lower position to the upper position for the depositing of additional printed products. An ejection element conveys the compressed bundle out of the holding area.

16 Claims, 7 Drawing Sheets

(56) References Cited

U.S. PATENT DOCUMENTS 5,282,716 A * 2/1994 Prim et al. ..... 414/790.3
5,387,077 A * 2/1995 Yatsuka et al. ..... 414/791
6,120,239 A * 9/2000 Roskam ..... 414/791.2
2006/0073007 A1 4/2006 De Matteis

* cited by examiner

APPARATUS AND METHOD FOR FORMING BUNDLES COMPOSED OF PRINTED PRODUCTS

CROSS-REFERENCE TO RELATED APPLICATION

This application claims the priority of the Swiss Patent Application No. 02015/10, filed on Nov. 30, 2010, the subject matter of which is incorporated herein by reference.

BACKGROUND OF THE INVENTION

The present invention relates to an apparatus and a method for forming bundles composed of printed products. Such an apparatus includes a holding area for successively supplied printed products, a lift provided with at least one lift element which can essentially move vertically up and down inside the holding area, as well as at least one ejection element for conveying the bundles out of the holding area. The printed products can be deposited onto the at least one lift element when it is located in an upper position. The printed products can initially be moved with the at least one lift element downward and into the holding area and can subsequently be compressed into a bundle with the aid of an upward movement that is directed against at least one pressing element of the apparatus. The bundle can be transported inside the holding area with the at least one lift element to a lower position for this lift element. For the depositing of additional printed products, the at least one lift element can then be moved once more from its lower position to its upper position.

An apparatus of this type, which is also called a bundle or layer press, as well as a corresponding method are known from European patent document EP 1593633A1 and are used to form bundles composed of printed products, such as newspapers, magazines or the like. The printed products are supplied, for example, in the form of an overlapping flow and are then stacked inside a stacking device. The stacks are compressed in the aforementioned apparatus and the resulting bundle is ejected so that it can be conveyed to further processing locations. During the compressing, the thickness of the stack is reduced by evacuating the air from the printed products. This is designed to form bundles having the highest possible stability with the stacked printed products, which are then suitable for shipping. The apparatus has a holding area that is open on the top and a therein positioned lift which can essentially move vertically up and down and comprises two so-called lift plates which are used for accommodating and compressing the printed products. The successively supplied printed products are deposited onto the lift plates, located in an upper position, and are initially moved downward with the aid of these plates into the holding area. For the compressing operation, the printed products are then moved upward again with the lift and pressed against two opposite-arranged pressing elements. Following the compressing of the printed products into a bundle, the latter is moved downward with the lift and is finally ejected with an ejection element from the holding area of the apparatus. The lift plates are then once more moved upward so that additional printed products can be deposited thereon. The lift in this case represents a limiting element for the successive forming of bundles because the lift can be moved back up into the starting position only after a bundle is ejected, so as to make it available once more for accommodating additional printed products.

European patent document EP 1826164A1 discloses an apparatus for forming bundles which also lifts up the printed products with the aid of a lift and which compresses the products by moving a pressing element across the products. With this apparatus, the lift is also moved downward for ejecting the finished bundles. However, only after the ejection of the bundle can the lift be moved back up for depositing additional printed products.

SUMMARY OF THE INVENTION

It is an object of the present invention to provide an apparatus and a method of the aforementioned type which make it possible to form bundles composed of printed products within a shorter time period while still continuing to ensure the quality and in particular the stability of the formed bundles.

The above and other objects are achieved according to the invention by the provision of an apparatus for forming bundles composed of printed products, which in one embodiment, comprises: a table presenting a support element defining a lower limit of a holding area that accommodates successively supplied printed products; at least one pressing element; a lift including at least one lift element to move essentially vertically up and down inside the holding area between a lower position and an upper position, the printed products being deposited on the at least one lift element when the at least one lift element is in the upper position, the lift operating to initially move the deposited printed products downward into the holding area so that the printed products are in a position to subsequently be compressed into a bundle by pressing the printed products with an upward movement against the at least one pressing element, the lift further operating to transport the compressed bundle in the holding area to the lower position where the at least one lift element is moveable at the lower position out of the holding area to a position in which the bundle is released to drop onto the support element, wherein the at least one lift element thereafter is moveable from the lower position to the upper position for the depositing of additional printed products; and at least one ejection element to convey the compressed bundle out of the holding area.

Accordingly, by providing a support element for the bundle which delimits the holding area in a downward direction and embodying the support element as a rotary table, it is possible to move the at least one lift element from its lower position to a position where the bundle may be released to the support element.

According to another aspect of the invention there is provided a method for forming bundles composed of printed products using an apparatus having a lift comprising at least one lift element that is moveable essentially vertically in a holding area between upper and lower positions, the method comprising in one embodiment: (a) depositing the printed products onto the at least one lift element when the at least one lift element is in the upper position in the holding area; (b) moving the at least one lift element with thereon deposited printed products downward and into the holding area; (c) moving the at least one lift element with thereon deposited printed products in upward direction and against a pressing element for compressing the printed products into a bundle; (d) moving the at least one lift element with thereon deposited bundle to the lower position in the holding area; (e) moving the at least one lift element in its lower position out of the holding area and into a position where the bundle is released to a support element; conveying the bundle out of the holding area with the aid of at least one ejection element; and (f) moving the at least one lift element from the lower position to the upper position for depositing additional printed products thereon.

As a result, the at least one lift element can be moved upward either during or even before the ejection of the formed bundle and into a position where additional printed products can be deposited thereon. Printed products can thus be deposited on the at least one lift element even if the formed bundle has not been ejected completely. In this way, the cycle time for forming bundles can be shortened considerably. In addition, it can be avoided that the printed products must travel unguided over a comparably long distance during the depositing process. With the apparatus and the method according to the invention, the distance traveled can be kept to a minimum which is good for the quality and especially for the stability of the formed bundles. Finally, this solution is space-saving and easy to configure and is therefore also suitable for a rotary table, which is used to deposit on the lift elements several stacks of printed products and/or bundles that are rotated by 180°, relative to each other.

According to one modification of the invention, the at least one lift element can essentially be moved horizontally into the position where the bundle can be released, wherein a horizontal movement of this type can be realized quickly and securely. In the process, the at least one lift element is pulled horizontally away from the printed products, so that these products drop down onto the support element. The lift element which is thus once more unoccupied can be moved upward and, preferably also with a horizontal movement, into its upper position. The horizontal movements are advantageously realized controlled and synchronized with the other sequences. These movements can be realized with pneumatic or hydraulic drive means or with the aid of a motor. The printed products can be compressed by raising the lift. During the depositing of several stacks, the lift is thus moved gradually downward, which makes it possible to form bundles composed of several stacks, even crosswise arranged stacks.

According to a different modification of the invention, at least one lift element is fork-shaped. As a result, side walls provided with openings can be used to delimit the holding area, wherein these side walls can be embodied, in particular, with vertical slots, inside of which the at least one lift element can move vertically up and down. In particular, the at least one lift element can be provided with rods projecting into the holding area, which are arranged similar to the tines of a fork and which can essentially be moved horizontally out of the holding area to release the formed bundle. These rods form an especially suitable support for the printed products to be compressed and furthermore permit an easy and careful dropping of the printed products.

According to yet another modification of the invention, the at least one lift element is arranged so as to be vertically displaceable with a guide element or along a guide element, wherein this guide element is advantageously arranged outside of the holding area. Adapting the format is made especially easy if the guide element is horizontally adjustable. The at least one lift element is preferably attached to a holder on the guide element.

A suitable drive mechanism for the vertical movement is, for example, a pneumatic or hydraulic cylinder or also a motor, wherein the horizontal movement can also be realized with the aid of a hydraulic or pneumatic cylinder or a motor.

The at least one lift element according to another modification of the invention is provided with an endless drive element for its vertical movement. This drive element can be a toothed belt such as a motor-driven belt. An endless drive element of this type can furthermore also be used for an apparatus with two lift elements. The endless drive element is guided in such a way that it comprises an inner and an outer belt section. One lift element is attached in that case to the outer belt section and the other lift element is attached to the inner belt section. The two lift elements can thus be moved simultaneously and synchronized up and down, wherein the two lift elements can respectively be guided along a vertical rail.

According to one modification of the invention, two separate pressing members are arranged on the support element, such that they can be pivoted around joints between an inactive and an active position. These pressing members consequently can be pivoted easily from an opened position for feeding printed products into the holding area to a closed position in which the printed products are compressed.

According to another modification of the invention, a stacking device is provided above the holding area for forming the stacks composed of the printed products and for releasing these stacks to the holding area. In particular, stacks composed of printed products which are supplied in an overlapping flow can be formed with this stacking device. In principle, however, printed products can also be processed which are not conveyed in an overlapping flow but are transported with the aid of clamps. The apparatus according to the invention furthermore makes it possible to form bundles consisting of a single layer or of several layers and, in particular, cross-stacked layers, wherein the bundles can be composed of identical printed products or different types of printed products.

Additional and advantageous features are derived from the following description, as well as the drawing.

BRIEF DESCRIPTION OF THE DRAWINGS

These and other features and advantages of the invention will be further understood from the following detailed description with reference to the accompanying drawings, showing in.

DETAILED DESCRIPTION

Figure 1:
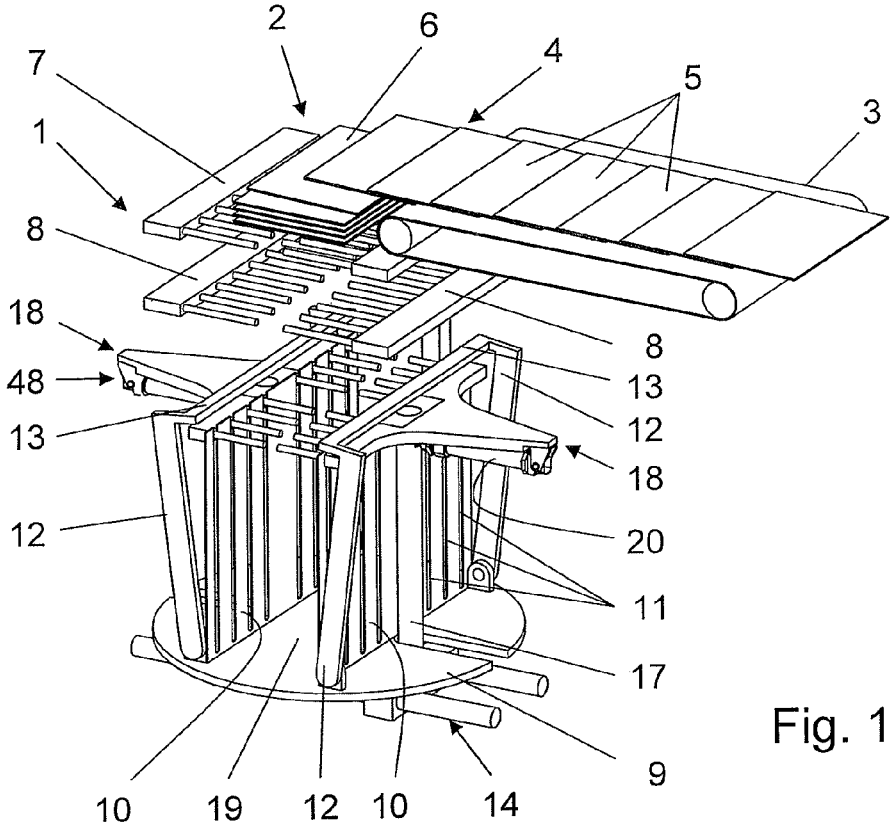
FIGS. 1 to 12 show schematic three-dimensional views of an apparatus according to the invention, depicting the individual stages during the forming of a bundle.

According to FIG. 1, the apparatus 1 is provided with a stacking device 2 which comprises two pre-stacking forks 7 and two positioning forks 8, arranged below. The forks 7 and 8 are guided horizontally displaceable on a frame that is not shown herein. With the aid of a motor, also not shown herein, the pre-stacking forks 7 and the positioning forks 8 can be moved horizontally toward each other or away from each other. Printed products 5 can be supplied in an overlapping flow 4 on a conveying belt 3 to the pre-stacking forks 7, so that a stack 6 can be formed thereon, wherein these printed products 5 can be newspapers, magazines, booklets and the like. However, the flow 4 can also consist of individual signatures or sheets.

Figure 2:
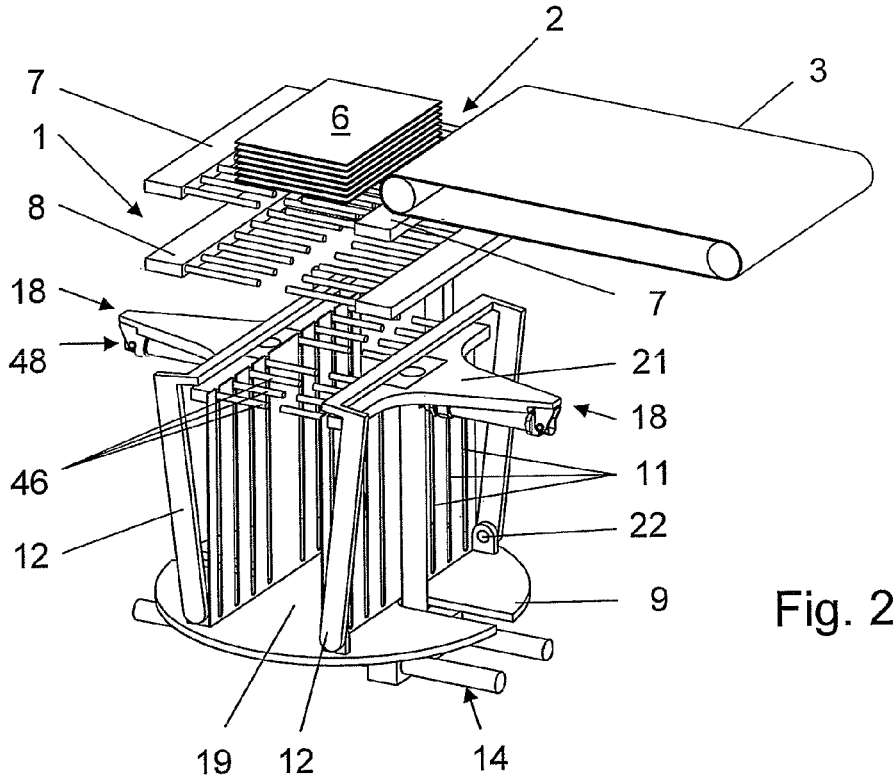
Figure 3:
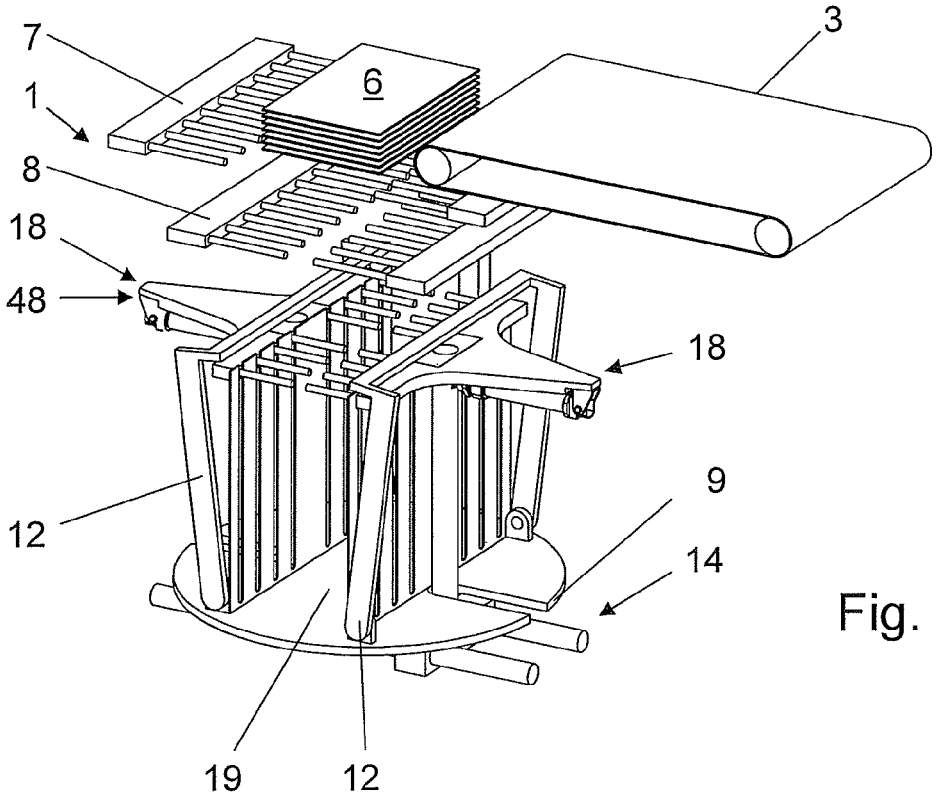
Figure 4:
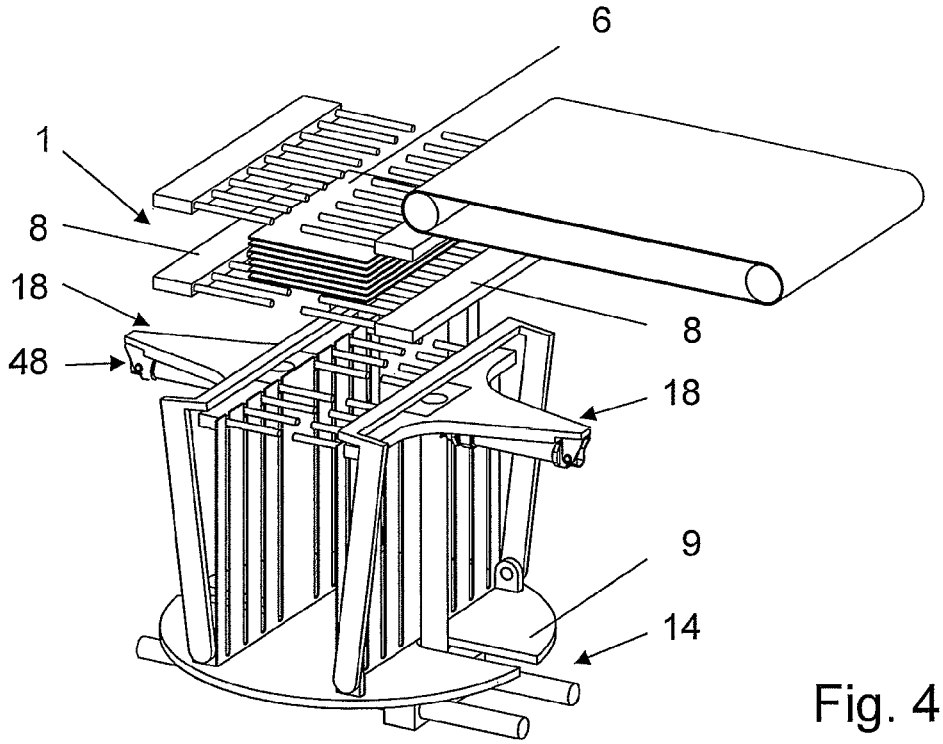
Figure 5:
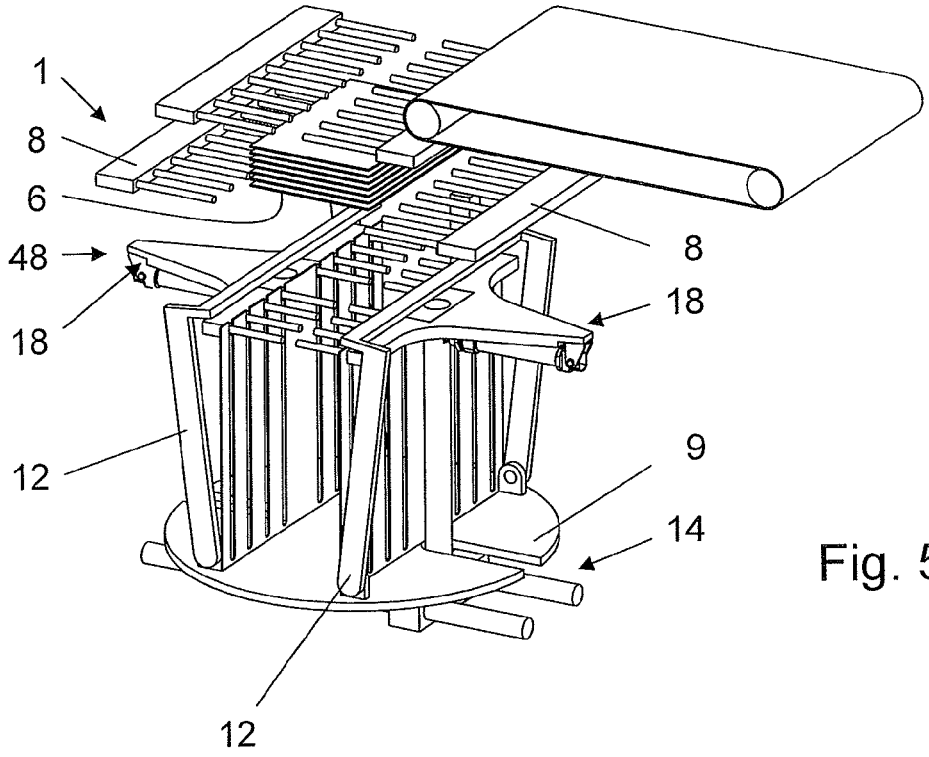
Figure 6:
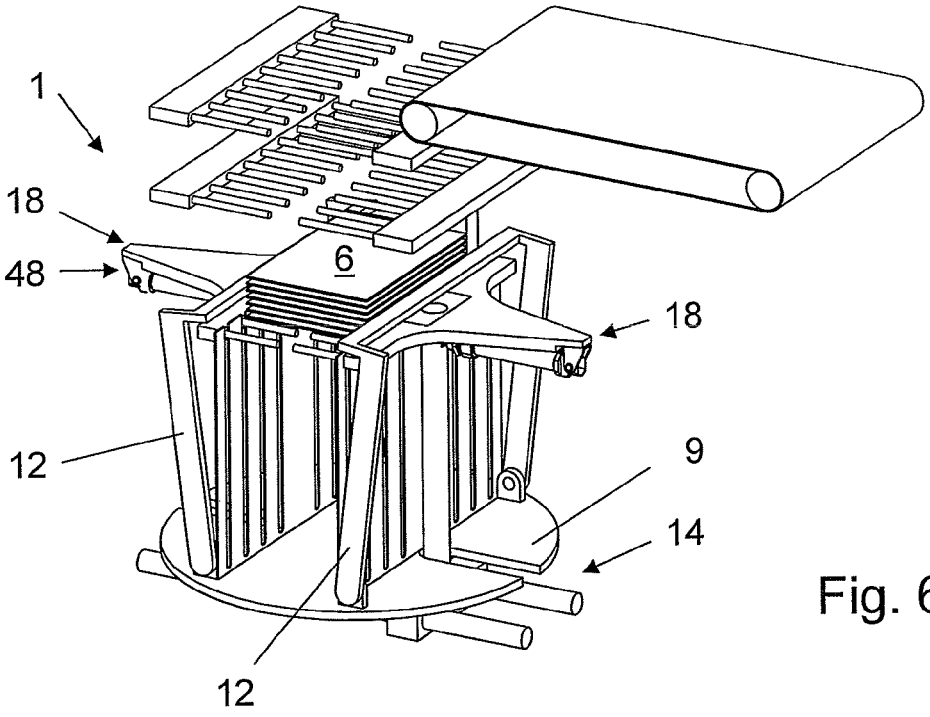

Once a complete stack 6 is formed, as shown in FIG. 2, the two pre-stacking forks 7 are moved apart to allow the stack 6 to drop down onto the positioning forks 8, as shown in FIGS. 3 and 4. The pre-stacking forks 7 are then moved once more back to the closed position so that a new stack 6 can be formed thereon. The positioning forks 8 are moved apart to allow the stack 6 to drop onto a lift 14 that is arranged below the positioning forks 8 and is provided with two lift elements 18, as shown in FIGS. 5 and 6. FIG. 6 shows the stack 6 which is deposited on the lift elements 18. Of course, the apparatus 1 can also be embodied without the pre-stacking forks 7 and the positioning forks 8. In that case, a stack 6 is formed directly on the lift elements 18.

The lift 14 is arranged on a rotating support element 9 which is embodied in particular as a table. According to FIGS. 1 to 6, the two lift elements 18 are in an upper position 48 inside a holding area 19 of the apparatus 1, which is delimited on the side by two side walls 10 and on the bottom by the support element 9, wherein the lift elements can move essentially vertically up and down inside the holding area 19 with the aid of the lift 14.

The two lift elements 18 are each attached to a vertical guide element 17, embodied as a support beam, of the lift 14 so that they can be displaced vertically up and down with these guide elements. The two guide elements 17 are located outside of the holding area 19, as can be seen, and also outside of the two side walls 10. For accommodating the stacks 6 in the holding area 19, the two lift elements 18 are embodied fork-shaped, meaning they are respectively provided with several horizontally extending rods 46 (FIG. 2), wherein each rod extends through a vertical, slot-shaped opening 11 in the respective side wall 10. The rods 46 extend parallel to each other and are respectively attached to a support element 21 of the corresponding lift element 18, such that they can move vertically up and down in the openings 11.

The spacing between the two vertical guide elements 17 and thus the spacing between the two lift elements 18 relative to each other can be adjusted. The vertical guide elements 17 are respectively positioned in sliding blocks 16 (FIG. 9), such that they can be displaced along rod-shaped horizontal guide elements 15. The vertical guide elements 17 can be displaced and the spacing between the lift elements 18 adjusted either manually or with a suitable drive means, in particular a motor. The support element 9 is provided with corresponding slots 24 (FIG. 11), so that the vertical guide elements 17 can also move in the support element. The spacing between the lift elements 18 must be changed if the format of the printed products 5 changes noticeably, wherein the spacing between the side walls 10 can be changed along with the format change.

Two pressing members 12 are respectively positioned on the support element 9 in such way that they can pivot around joints 22 (FIG. 2) between an active and an inactive position. FIGS. 1 to 7 as well as FIGS. 9 to 12 show the two pressing elements 12 in the inactive, meaning the opened position. In FIG. 8, the two pressing members 12 are pivoted to the active, meaning the closed position. The pressing members are pivoted with the aid of a drive that is not shown herein, for example a drive operating with a pneumatic or a hydraulic cylinder, wherein a different drive can also be used, for example a motor.

Figure 7:
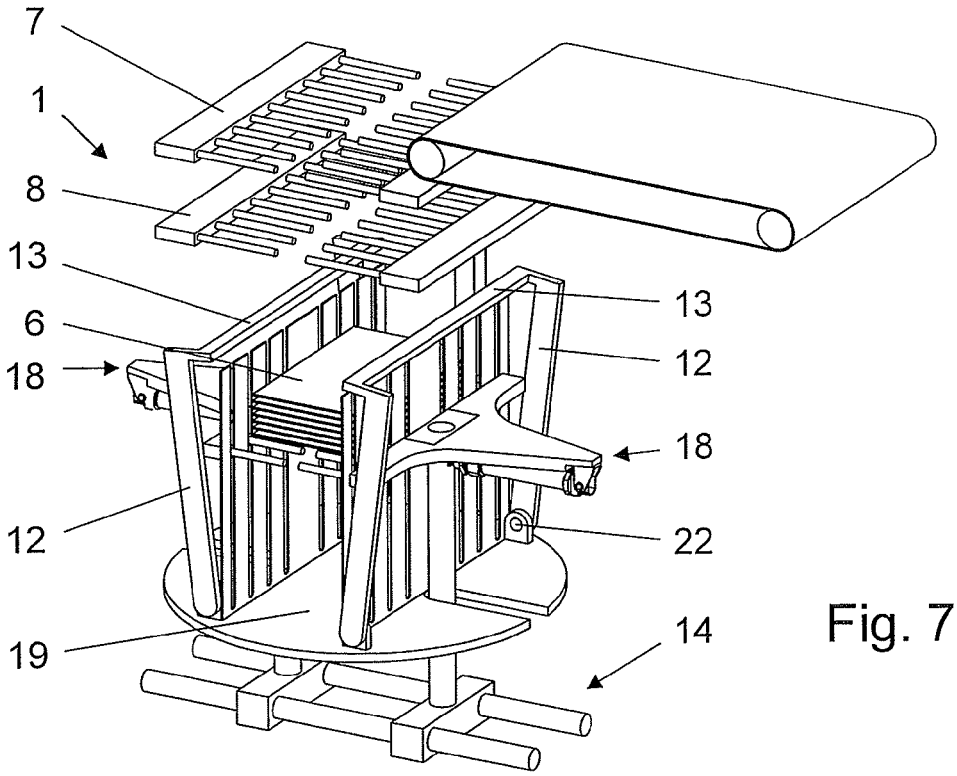
Figure 8:
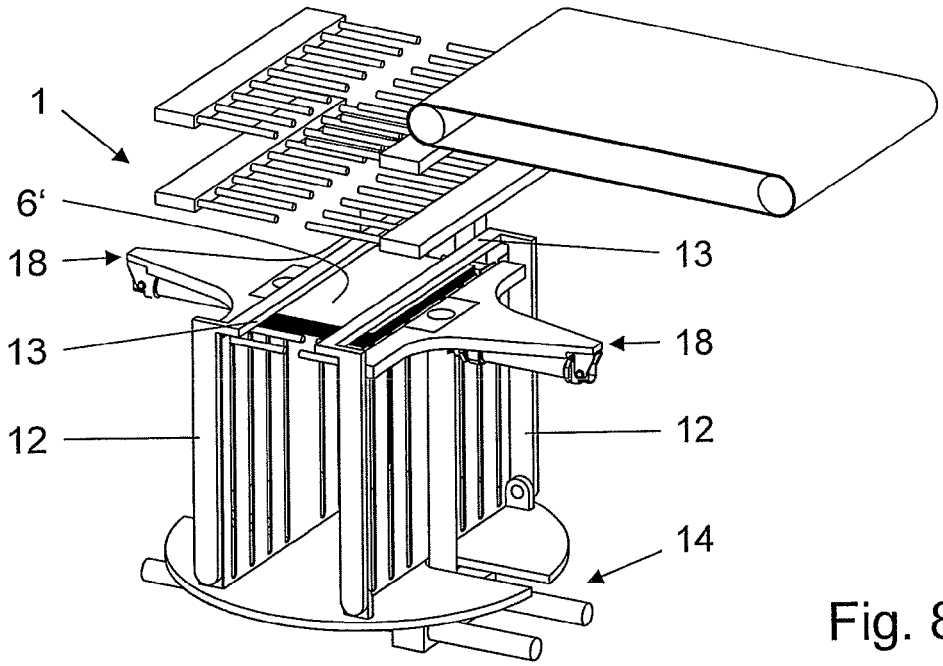

For the further processing, the stack 6 is initially moved with the lift 14 downward and into the holding area 19, to the position shown in FIG. 7. The stack 6 is then moved from this position upward and pressed against the shoulders 13, embodied as end stops, of the pressing elements 12 which are pivoted to the active position. While the stack 6 is pressed against these shoulders, the air contained therein is mostly expelled. The thickness of the stack 6 is reduced in this way, so that the stack subsequently forms a relatively stable bundle 6'. Figure shows such a bundle 6' in the compressed state. In general, the bundle 6' formed with the stack 6 can also consist of several layers, wherein the method steps according to FIGS. 4 to 8 must be repeated several times for each layer during the compressing operation.

Figure 9:
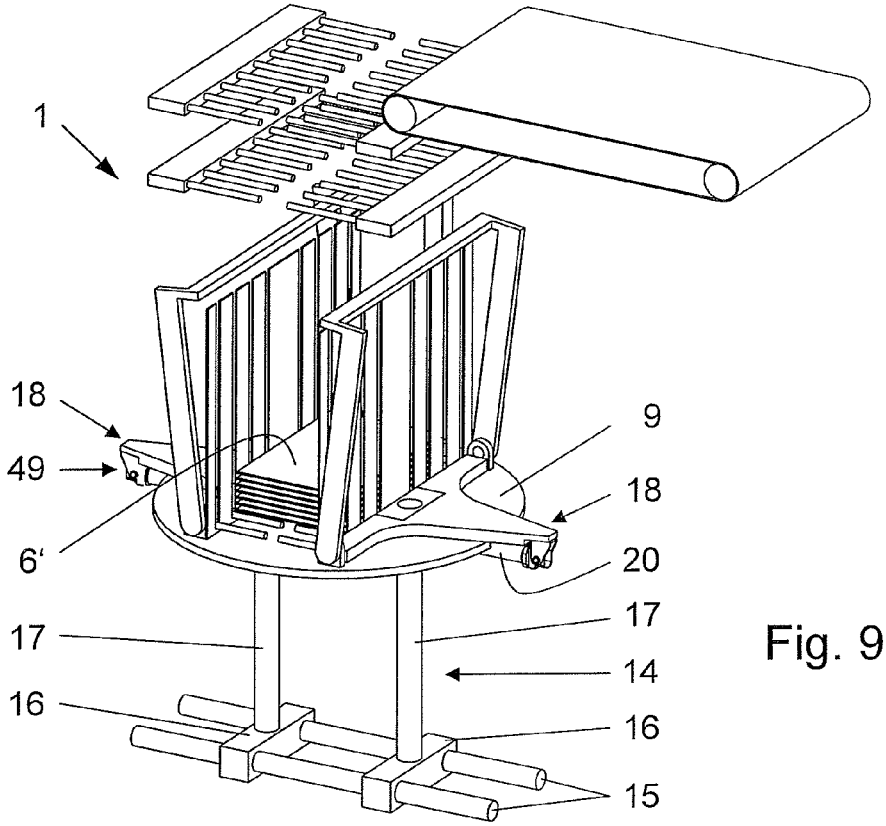
Figure 10:
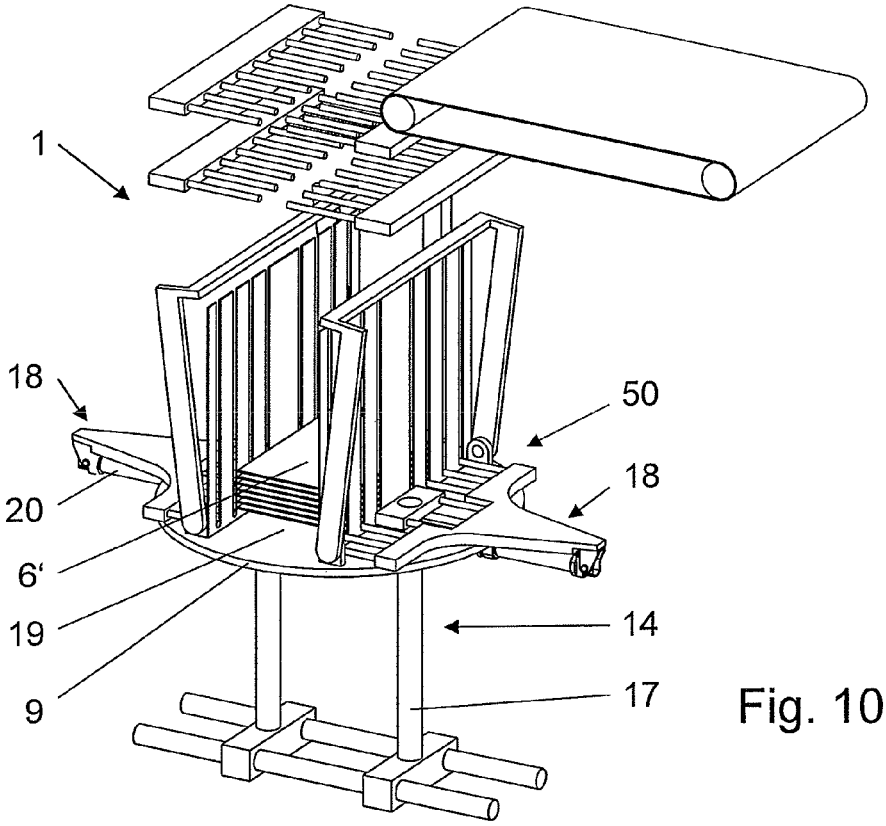

By further lowering the lift 14 and thus also the two lift elements 18, the bundle 6' can continue to be moved downward, so that it finally is located directly above the support element 9 in a lower position 49 of the lift elements 18, as shown in FIG. 9. With the drive (see FIGS. 1, 9), for example provided with a pneumatic or a hydraulic cylinder or a motor, the two lift elements 18 are then moved from their lower position respectively in the horizontal direction far enough toward the outside to reach a position 50 where the bundle 6' is released, so that the lift elements are no longer engaged in the holding area 19. In the position 50, the lift elements 18 no longer support the bundle 6' which then drops down onto the support element 9 (FIG. 10). For this, the drives 20 are respectively arranged between the outer end of the lift element 18 and the vertical guide element 17, as can be seen in FIGS. 1 to 12. With the aid of an ejection element 23, which moves horizontally through the holding area 19, the bundle 6' is then ejected and can be taken over by a transport and/or processing device that is not shown herein. The bundle 6', for example composed of magazines, is subsequently made available for the shipping.

Figure 11:
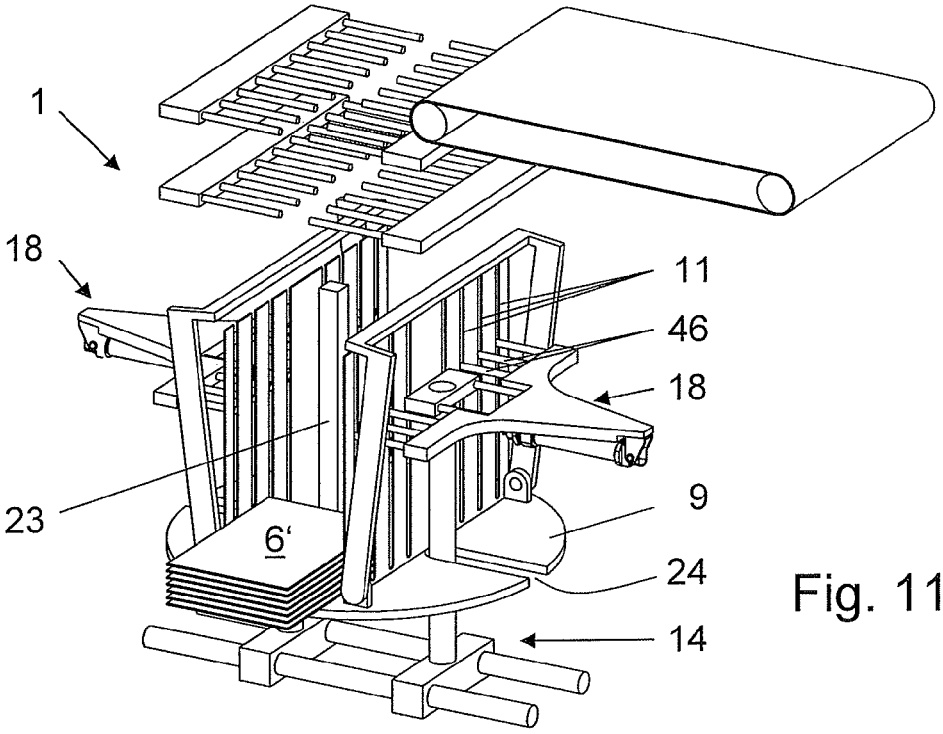
Figure 12:
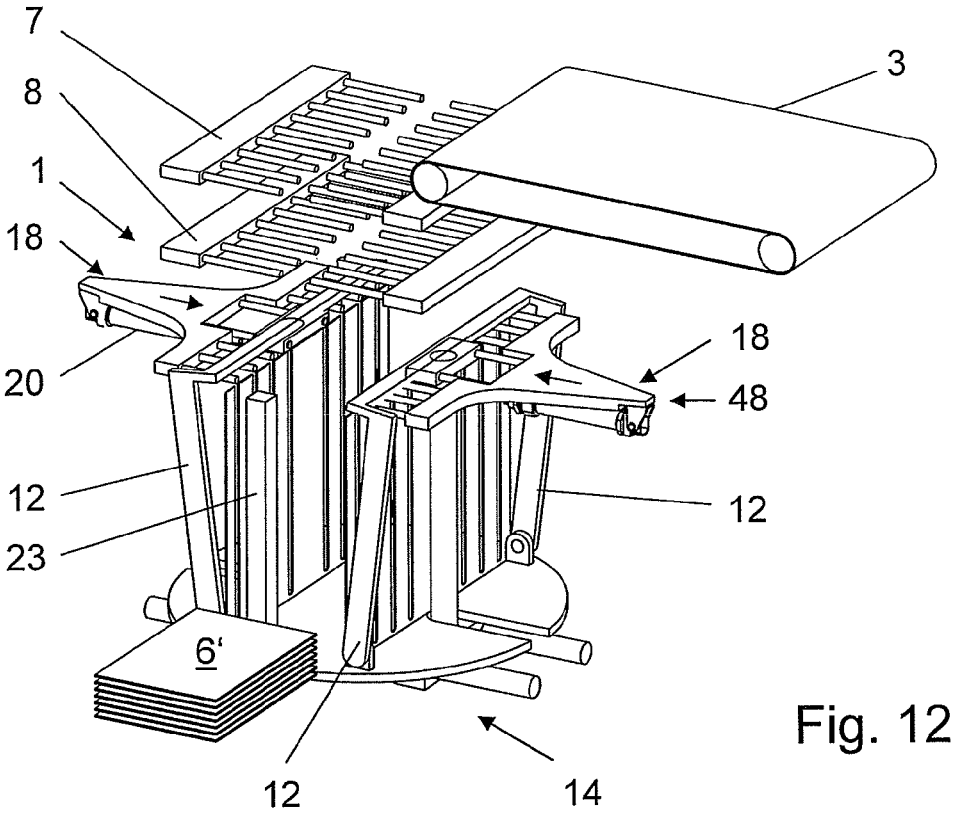

If the two lift elements 18 are moved apart into the position 50 and if the bundle 6' is thus deposited onto the support element 9, the two lift elements 18 can be moved back up immediately with the aid of the lift 14, to a position shown in FIG. 11. During this operation, the deposited bundle 6' is ejected with the aid of an ejection element 23, as shown in FIGS. 11 and 12. As indicated with arrows in FIG. 12, the two lift elements are then moved toward each other once more and into the position shown in FIG. 1, wherein this is also realized with the drives 20. These drives are controlled in the same way as the other drives by a control unit that is not shown herein. The two lift elements 18 are thus ready for the deposit of another stack 6. Depending on the concrete embodiment of the apparatus 1 and the application situation, the two lift elements 18 can again move up and into the upper position 48, in which additional printed products 5 can be deposited, either before or during the ejection of the bundle 6'.

Figure 13:
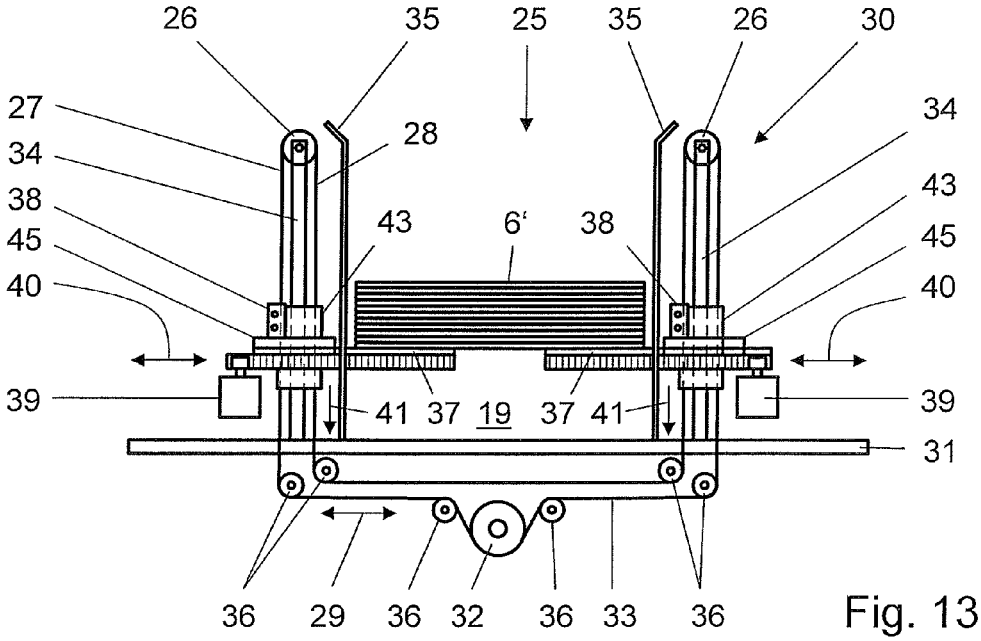
FIG. 13 shows a schematic view from the side of an apparatus according to one modification of the invention.
Figure 14:
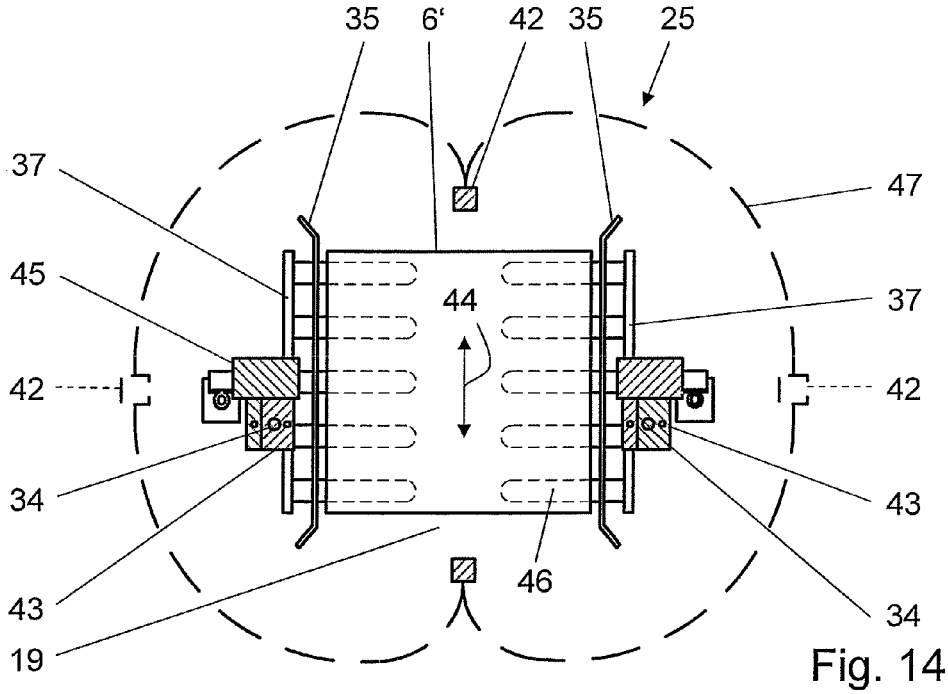
FIG. 14 shows the apparatus according to FIG. 13 as seen from above.

The apparatus 25, shown in FIGS. 13 and 14, differs from the above-described apparatus 1 in particular by the design of a lift 30 which comprises two lift elements 37 that can be moved vertically and horizontally. The lift 30 is arranged on a support element 31, embodied rotating, which can essentially be embodied in the same way as the above-mentioned support element 9. Two upward projecting, rod-shaped or similarly shaped, suitable guide elements 34 are attached to the support element 31. Respectively each guide part is displaceable up or down along the vertical guide elements 34, wherein the guide elements 34 are also arranged outside of the side walls 35. The guide parts 43 are respectively attached with a holding part 38 to an endless drive element 33, guided over deflection rollers 26 and 36. The deflection rollers 26 are respectively arranged on an upper end of a guide element 34. The endless drive element 33 shown in FIG. 13, which can be embodied belt-shaped for example, essentially has a U-shaped form and thus comprises an outer belt section 27 and an inner belt section 28. The holding part 38, shown on the right in FIG. 13, is connected to the inner belt section 28 and the holding part 38 shown on the left is connected to the outer belt section 27. A motor 32, for example a servomotor, is provided for driving the drive element 33 and is connected to the outer belt section 27. If the drive element 33 is moved in one of the two directions of the double arrow 29, then the two lift elements 37 in the holding area 19 move jointly either up or down. A stack 6 or a bundle 6', deposited on the lift elements 37, can thus be moved up or down according to FIG. 13. The bundle 6' is guided on the side by the two side walls 35. If the outer belt section 27 of the drive element 33 moves in counter-clockwise direction, meaning to the right in the region of the motor 32 in FIG. 13, the two lift elements 37 move down as shown with the arrows 41. Of course, the drive element 33 can also be embodied as a link chain.

For the horizontal movement, the lift elements 37 are respectively positioned with the aid of a bearing part 45, wherein each bearing part 45 is connected to the respective guide part 43. With the aid of a motor 39, for example embodied as a servo motor, the two lift elements 37 can respectively be moved horizontally in the direction of the double arrow 40. Different drive elements can conceivably be used in place of the motors 39, for example pneumatic or hydraulic cylinders. The lift elements 37 can be embodied similar to the lift elements 18 and can be provided with parallel-extending vertically movable rods 46. In the same way, the side walls 35 can be embodied corresponding to the side walls 10 and can contain openings 11, not shown herein, for the rods 46. The function of the lift elements 37 thus corresponds to the function of the lift elements 18. In the position shown in FIG. 13, the two lift elements 37 can be moved horizontally toward the outside and into the position, not shown herein, outside of the holding area (corresponding to position 50 in FIG. 10), so that the compressed stack 6 in the form of the bundle 6' drops onto the support element 31. From this support element, the bundle 6' can then be ejected with the ejection element 42 in one of the directions shown with the double arrow 44. The ejection element 42 can be moved to the other side of the support element 31 along a curve 47 that is shown with a dashed line. The ejection element can be embodied as a rod which projects upward from the support element 31 and is correspondingly guided and driven. The lift elements 37 for this embodiment can also be moved to an upper position, either before or during the ejection of the bundle 6' and can thus be made available for receiving another stack 6. As a result, the cycle time for forming an additional bundle 6' can be reduced considerably.

It will be understood that the above description of the present invention is susceptible to various modifications, changes and adaptations, and the same are intended to be comprehended within the meaning and range of equivalents of the appended claims.

What is claimed is:

1. An apparatus for forming bundles composed of printed products, comprising:

a turntable presenting a support element defining a lower limit of a holding area that accommodates successively supplied printed products;

at least one pressing element movable between an active position and an inactive position and defining an upper limit of the holding area when the at least one pressing element is in the active position;

at least two side walls arranged at a distance to each other to delimit sides of the holding area;

a lift including at least one lift element to move essentially vertically up and down inside the holding area between a lower position and an upper position, the printed products being deposited on the at least one lift element when the at least one lift element is in the upper position, the lift operating to initially move the deposited printed products downward into the holding area so that the printed products are in a position to subsequently be compressed into a bundle by pressing the printed products with an upward movement against the at least one pressing element in the active position, the lift further operating to transport the compressed bundle in the holding area to the lower position where the at least one lift element is moveable essentially horizontally at the lower position out of the holding area to a position in which the bundle is released to drop onto the support element, wherein the at least one lift element thereafter is moveable from the lower position to the upper position for the depositing of additional printed products; and at least one ejection element to convey the compressed bundle out of the holding area.

2. The apparatus according to claim 1, further comprising a hydraulic, pneumatic or motorized drive coupled to move the at least one lift element to the position where the bundle is released.

3. The apparatus according to claim 1, wherein the at least one lift element is fork-shaped.

4. The apparatus according to claim 3, wherein the at least one lift element comprises rods which project into the holding area to accommodate the printed products and which are moveable essentially horizontally out of the holding area to release the bundle.

5. The apparatus according to claim 1, further comprising a guide element, the at least one lift element being vertically displaceable with or along the guide element.

6. The apparatus according to claim 5, further comprising an endless drive coupled to the at least one lift element.

7. The apparatus according to claim 1, wherein at least one of the side walls includes vertical slots through which the at least one lift element extends in at least some sections to accommodate printed products in the holding area.

8. The apparatus according to claim 1, wherein the at least one lift element comprises two lift elements which respectively project at least partially into the holding area for the deposit and transport of printed products, the two lift elements being moveable jointly upward to compress the printed products to form the bundle and moveable substantially away from each other in a horizontal direction to release the bundle.

9. The apparatus according to claim 8, wherein the two lift elements are guided vertically outside of the holding area.

10. The apparatus according to claim 1, wherein the at least one pressing element comprises two pressing elements each being arranged on the support element and pivotable around respective joints between the inactive position and the active position.

11. The apparatus according to claim 1, further comprising a stacking device arranged above the holding area and adapted for forming stacks composed of printed products and for releasing the stacks to the holding area.

12. A method for forming bundles composed of printed products with an apparatus having a lift comprising at least one lift element that is moveable essentially vertically in a holding area between upper and lower positions, wherein the holding area is delimited in a downward direction by a turntable constituting a support element for the bundle, is delimited on opposing sides by at least two side walls arranged at a distance to each other and is delimited in an upward direction by at least one pressing element when the pressing element is moved into an active position, the method comprising:

a) depositing the printed products onto the at least one lift element when the at least one lift element is in the upper position in the holding area;

b) moving the at least one lift element with thereon deposited printed products downward and into the holding area;

c) moving the at least one lift element with thereon deposited printed products in upward direction and against the at least one pressing element in the active position for compressing the printed products into a bundle;

d) moving the at least one lift element with thereon deposited bundle to the lower position in the holding area;

e) moving the at least one lift element in its lower position essentially horizontally out of the holding area and into a position where the bundle is releasable to a support element;

f) conveying the bundle out of the holding area with the aid of at least one ejection element; and g) moving the at least one lift element from the lower position to the upper position for depositing additional printed products thereon.

13. The method according to claim 12, including vertically displacing the at least two lift elements with aid of or along a guide element.

14. The method according to claim 12, wherein the at least one lift element includes two lift elements which respectively project at least partially into the holding area for accommodating and transporting the printed products, and wherein step (c) includes moving the two lift elements together vertically upward for compressing the printed products into the bundle.

15. The method according to claim 14, wherein step (g) includes guiding the two lift elements vertically outside of the holding area.

16. The method according to claim 12, further including forming stacks composed of the printed products in a stacking device arranged above the holding area and releasing the printed products in the form of stacks to the holding area.

* * * * *